US005134748A

United States Patent [19]

Lynn

[11] Patent Number: 5,134,748

[45] Date of Patent: Aug. 4, 1992

[54] SURFACE CLEANING DEVICE

[76] Inventor: William R. Lynn, 38 Prospect St., Dover, N.H. 03820

[21] Appl. No.: 639,880

[22] Filed: Jan. 11, 1991

[51] Int. Cl.[5] ..... A47L 7/00

[52] U.S. Cl. ..... 15/321; 15/322; 15/353; 15/393; 15/394

[58] Field of Search ..... 15/321, 353, 393, 394, 15/322

[56] References Cited

U.S. PATENT DOCUMENTS

| | | | |
|---|---|---|---|
| 2,506,077 | 5/1950 | Goldsmith | 15/322 |
| 3,173,164 | 3/1965 | Congdon | 15/353 X |
| 3,431,582 | 3/1969 | Grave | 15/321 |
| 3,538,535 | 11/1970 | Ginsburgh et al. | 15/322 X |
| 3,591,889 | 7/1971 | Wisner | 15/322 X |
| 4,123,818 | 11/1978 | Hurwitz | 15/321 |
| 4,161,802 | 7/1979 | Knight et al. | 15/322 X |
| 4,170,805 | 10/1979 | Kumagai | 15/322 X |
| 4,437,203 | 3/1984 | Wisner | 15/322 |
| 4,833,752 | 5/1989 | Merrick | 15/322 |

*Primary Examiner*—Chris K. Moore

*Attorney, Agent, or Firm*—Davis, Bujold & Streck

[57] ABSTRACT

A surface cleaning system which allows a sponge or other cleaning element to receive cleaning fluid transported by conduit from a pressurized cleaning fluid container and to apply the same to a surface to be cleaned. A vacuum source extracts the used cleaning fluid from the surface as the operator moves the cleaning element back and forth over the surface to be cleaned to remove the cleaning fluid and contaminants therefrom. The used cleaning fluid then travels by a conduit to a separation container where it is filtered and collected. The used cleaning fluid or fresh fluid can be pumped by a sump pump to a flush basin for rinsing or cleaning the cleaning element. The sump pump is controlled by a pressure valve located in the base of the flush basin. The complete system is typically operated on 115VAC and is portable by way of a push cart.

18 Claims, 2 Drawing Sheets

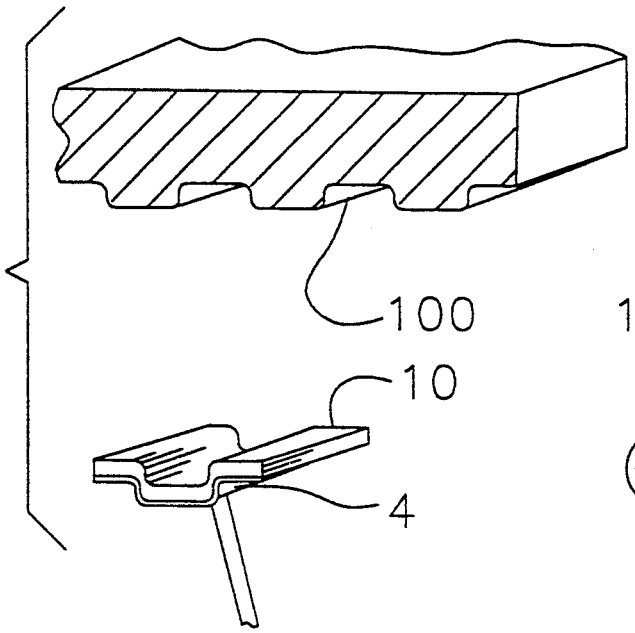
FIG. 4
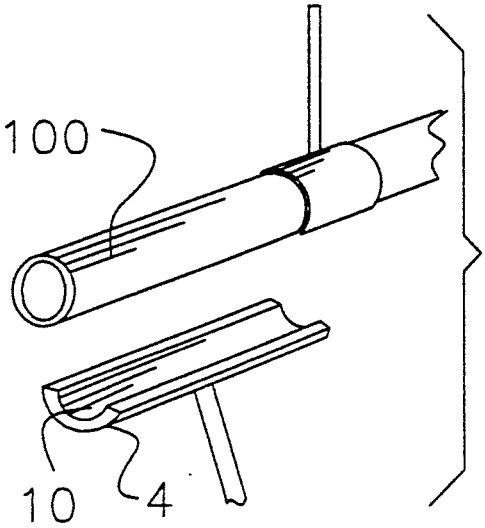
FIG. 3
FIG. 2
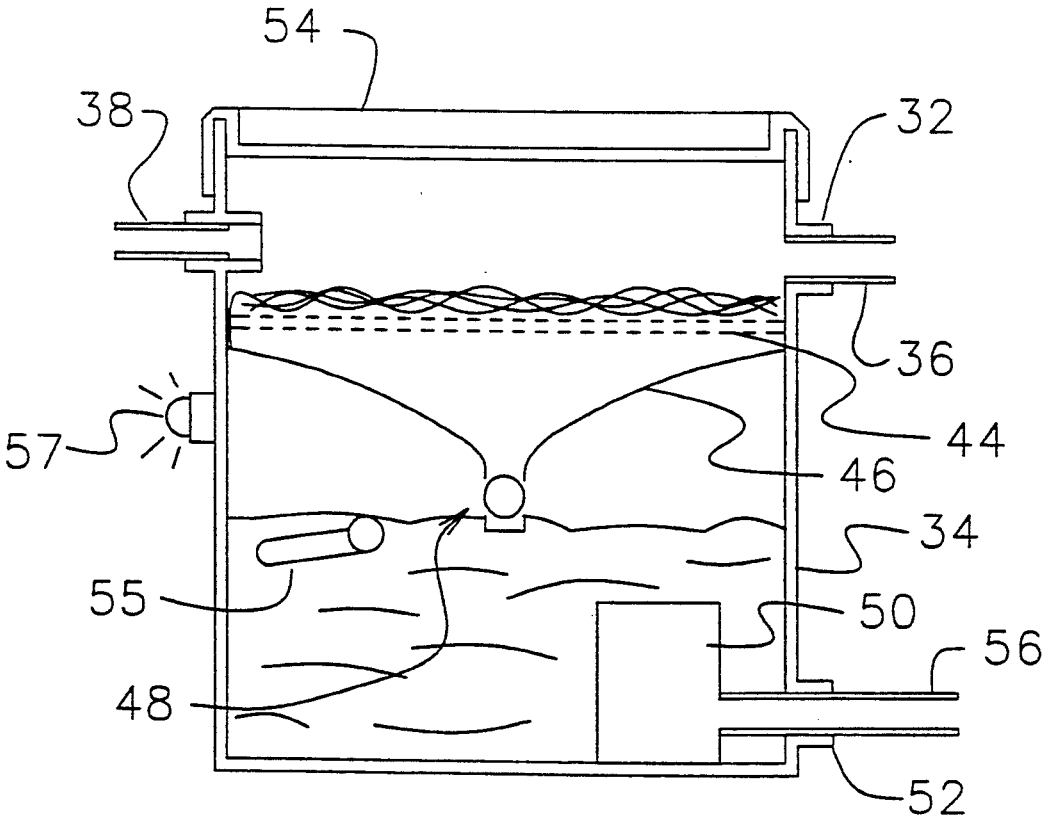

SURFACE CLEANING DEVICE

This invention relates to improvements concerning a surface cleaning device and, more particularly, to a surface cleaning device which is able to discharge a cleaning solution directly onto a surface to be cleaned and remove that cleaning fluid and any contaminants from that surface, after sufficient cleaning has occurred, directly through the cleaning element with only a negligible loss of cleaning fluid to the environment.

BACKGROUND OF THE INVENTION

There are cleaning systems presently in use which supply a cleaning solution, via conduit means, to a cleaning head which allows the cleaning solution to be applied directly to the surface to be cleaned. Thereafter, a separate collection system, such as a rag, a sponge or the like, is used to remove the applied cleaning solution and the contaminants from the surface being cleaned. However, such known cleaning apparatuses are relatively inefficient, cumbersome to operate and labor intensive. In addition, such known devices are not contoured to closely follow a contoured surface being cleaned.

Wherefore, it is an object of the present invention to provide a cleaning system in which the cleaning solution is applied to and removed from the surface to be cleaned via the same applicator.

A second object of the invention is to apply a cleaning solution through a sponge (plastic, natural, cellulose, rubber, etc.) or other open or porous cleaning element on to a surface to be cleaned and, after sufficient cleaning has occurred, to remove the cleaning solution and the dislodged contaminants directly through the sponge or other cleaning element.

Another object of the invention is to provide a surface cleaning device which is relatively simple to use and minimizes the amount of cleaning fluid and/or contaminants which escape from the cleaning device, during use, into the environment.

A further object of the invention is to provide a flushing system for the sponge or other cleaning element which thoroughly cleans the same once it has become sufficiently contaminated so that the sponge or other cleaning element may be reused repeatedly.

A still further object of the invention is to provide the sponge or other element with an exterior surface or contour that closely conforms with the contour of the surface being cleaned, such as a pipe, molding, etc., so that the sponge or other element can closely follow the contour of that surface thereby, ensuring that the entire surface is thoroughly cleaned with a minimal amount of passes and effort.

These and other objects of the invention will become apparent to those skilled in the art once the invention is better understood by having referenced the attached drawings and the following description.

SUMMARY OF THE INVENTION

The foregoing objectives are achieved in a preferred embodiment of a surface cleaner system which includes a surface cleaning device comprising a scrubber head defining a cavity in one surface thereof with a dispensing inlet and a removal outlet being provided within the cavity; a cleaning element being positioned within the cavity and having a surface communicating with the dispensing inlet and the removal outlet; a supply of cleaning fluid; means for supplying the cleaning fluid from the supply of cleaning fluid to the dispensing inlet, through the cleaning element and onto a surface to be cleaned as desired; and means for removing the cleaning fluid along with any contaminants, removed from the surface to be cleaned, directly through the cleaning element after sufficient cleaning of the surface has occurred.

When an operator activates the device, cleaning solution is pressure fed from the cleaning solution container, via a conduit, through the dispensing inlet and the cleaning element onto the surface to be cleaned. Then, the operator moves the scrubber head back and forth over the surface to achieve the desired cleaning. Thereafter, the dispensed cleaning solution is recaptured and sucked back into the device through removal outlet(s) located along the perimeter of the scrubber head. The used cleaning solution is sucked from the scrubber head through a conduit into the used cleaning solution container where it is filtered except for the gaseous portion which is sucked back through a conduit into a vacuum container.

BRIEF DESCRIPTION OF THE DRAWINGS

The present invention will now be described, by way of example, with reference to the accompanying drawings in which:

FIG. 2 is an enlarged fragmentary view of the separation container of FIG. 1;

FIG. 3 is a diagrammatic perspective view showing a second embodiment of the cleaning element and scrubber head; and FIG. 4 is a diagrammatic perspective view showing a third embodiment of the cleaning element and scrubber head.

DESCRIPTION OF THE PREFERRED EMBODIMENT

Figure 1:
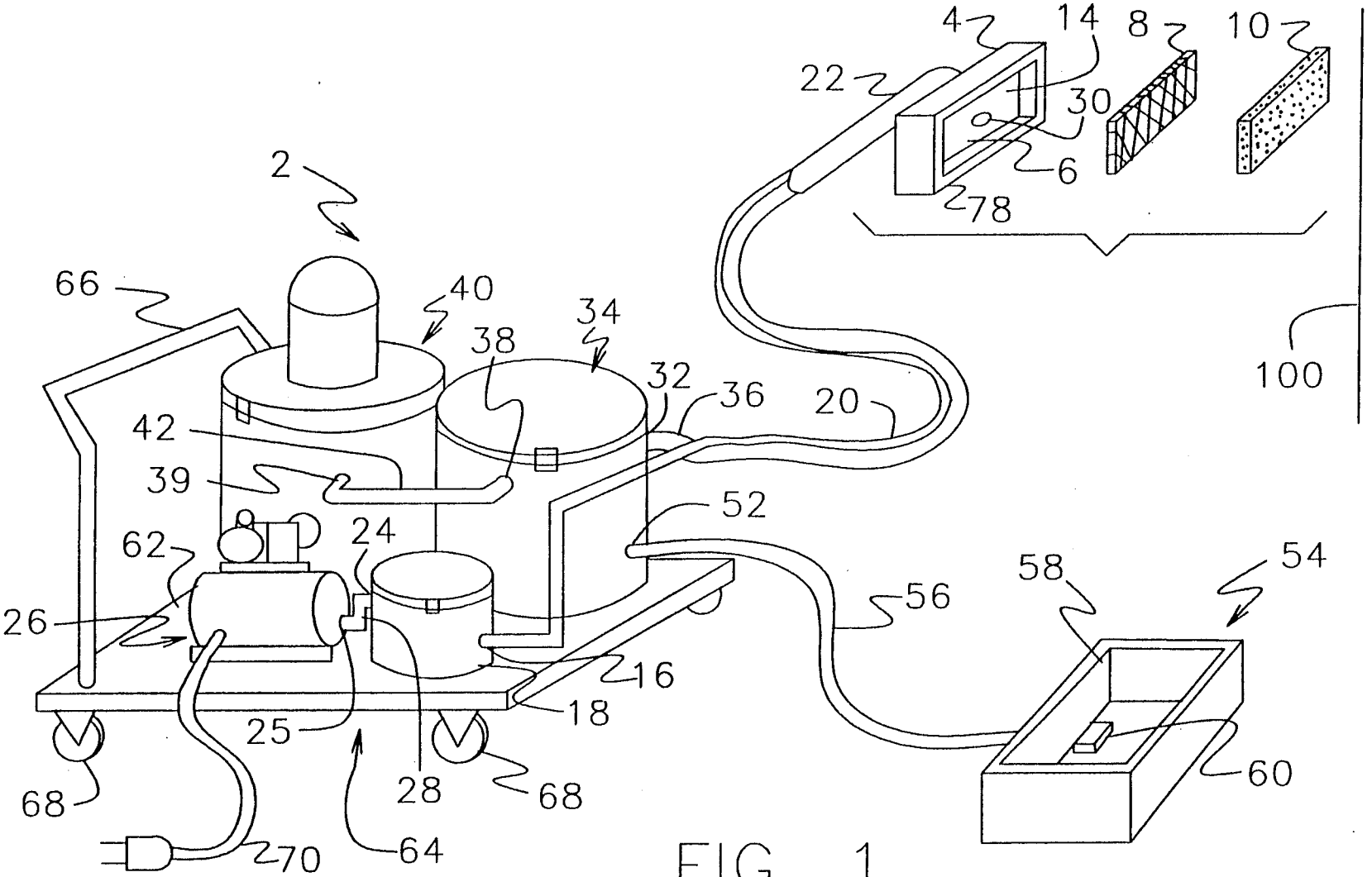
FIG. 1 is a diagrammatic perspective view of a preferred embodiment of the surface cleaning device of the present invention.

With reference to FIGS. 1 and 2, the surface cleaning device of the present invention will now be described in detail. The device 2 comprises a scrubber head 4 defining a cavity 6 on one face thereof for accommodating a support grating or screen 8 and a cleaning element 10. The cavity 6 is deep enough to receive the screen 8 and a substantial portion of cleaning element 10, which preferably will project slightly outside of the cavity 6 of the scrubber head 4. The cleaning element 10 is preferably an open cell sponge or other similar material which allows the cleaning solution to pass readily therethrough. The screen 8 and the cleaning element !0 are the same size and both have a sightly smaller surface area than the area of the opening to the cavity 6 so that they are closely received therein.

The screen 8 is provided to support the cleaning element 10 uniformly within the cavity 6 of the scrubber head 4 so that the element is supported when the cleaning solution and contaminants are being removed from the surface to be cleaned by suction, as described hereinafter.

A cleaning solution dispensing inlet 14 is provided in the base of the cavity 6 and is connected to an outlet 16 of a cleaning solution container 18 via a flexible conduit 20. A cleaning solution switch 22 is provided on an exterior surface of the scrubber head 4 and connected to pressurization means 26 to allow an operator to control the flow of cleaning solution from the cleaning solution supply container 18 to the scrubber head 4. An inlet 24 of supply container 18 is connected with an outlet 25 of the air pressurization means 26, such as an air compressor, via a conduit 28. The pressurization means 26 is powered by a battery or an electrical power source 70 and is activated by the switch 22 to pressurize the supply container 18 and thereby cause the cleaning solution to flow through conduit 20, the dispensing inlet 14, the screen 8 and the cleaning element 10 onto the surface to be cleaned 100.

At least one removal outlet 30, provided in the base of the recess 6, is connected with an inlet 32 of a separation container 34 via a flexible conduit 36. A first outlet 38 of the separation container 34 is connected with an inlet 39 of a vacuum source 40 via a conduit 42. The vacuum source 40 achieves a negative pressure and can be a vacuum pump, for instance. The vacuum source removes the applied cleaning solution, water, dirt and/or other contaminants and debris from the surface being cleaned through the cleaning element and conveys them into the separation container 34 via the removal outlet 30, the conduit 36 and the inlet 32. The liquid and solid constituents are separated and collected in the separation container 34 while the gaseous components are drawn from the container into the vacuum source 40 via the first outlet 38 and the conduit 42.

With reference to FIG. 2, a more thorough understanding of the separation container can be had. The separation container 34 is provided with a filter 44, in the top portion thereof, which filters the solid components from the used cleaning solution. A funnel 46, positioned adjacent the filter 44, channels the used cleaning solution through a one way valve 48 into the bottom portion of the container. A sump pump 50 is connected with a second outlet 52 of the container and this outlet is connected with an inlet of a flushing basin 54 (see FIG. 1) via a conduit 56. The flushing basin 54 defines a cavity 58 which is shaped and sized to receive closely at least the cleaning element 10 and preferably the entire scrubber head 4. The base of the flushing basin 54 is provided with a pressure activated switch 60 or other similar mechanism which, when activated, turns on the sump pump 50 to pump an ample supply of used cleaning solution from the bottom portion of the separation container 34 to the cavity 58 of the flushing basin 54. The switch 60 also simultaneously activates the vacuum source 40 so that the supplied used cleaning solution is drawn through the cleaning element 10 of the scrubber head 4 and returned to separation container 34 via the inlet 32 and the conduit 36. This circulation of the fluid through the cleaning element 10 continues until the cleaning element 10 has been sufficiently rinsed and/or cleaned. Thereafter, the cleaning element is used for further cleaning and when sufficiently contaminated again, the above process is repeated. Alternatively, the conduit 56 could be connected to a faucet or other fresh water supply to provide cleaning fluid to the flushing basin for cleaning the cleaning element.

The device 2 can be carried on a support surface 62 of a push cart 64 (see FIG. 1). The cart is preferably provided with a handle 66 and wheels 68, typically three or four wheels, which allow the push cart 64 to be easily maneuvered into position. An electrical power source 70, such as a battery or an electrical cord to be plugged into a wall outlet, can be used to power the vacuum source 40, the pressurization means 26, and the other components requiring electrical power for operation.

It is to be appreciated that an exterior surface of the cleaning element 10 and/or the scrubber head 4 can be formed so that they closely conform to the profile of the surface or object to be cleaned. For instance, if the device is to be used to clean a long section of pipe, the portion of the scrubber head adjacent the cavity could have a radius contour and at least the exterior surface of the cleaning element 10 would have a radiused contour similar to the radius of the pipe to be cleaned, as can be seen in FIG. 3. It is also possible the cleaning element 10, if molding or other non-uniform surfaces are to be cleaned, could be extruded, vacuum formed or injection molded to have an exterior surface or profile which closely conforms to the contour of the surface to be cleaned so that all of the surfaces, grooves and corners of the object (molding for example) would be adequately cleaned in one or two passes of the device (see FIG. 4).

Regardless of the surface to be cleaned, it is important that the cleaning element 10 and scrubber head 4 closely engage and conform to the surface to be cleaned so as to maintain a sufficient seal with the surface which facilitates removal of the applied cleaning solution and the contaminants therefrom.

The supply container could also be provided with a float device 55 (see FIG. 2) which, when raised by a sufficient quantity the used cleaning fluid collecting in the bottom portion of the tank, would deactivate the switch 22 and indicate to the operator, by a light or other warning device 57, that the separation tank is full and requires emptying through the cover 54.

It is preferable that the dispensing inlet 14 be centered in the base of the scrubber head 4 and that the removal outlet(s) 30 be equally spaced about the perimeter of the scrubber head 4. This arrangement facilitates the application of the cleaning solution to the surface to be cleaned and removal of such fluid and surface contaminants with only minor leakage into the environment.

It is also possible that the perimeter of the scrubber head located adjacent the surface to be cleaned could be provided with a circumferential seal, such as a foam rubber gasket or the like 78 (see FIG. 1), to facilitate sealing of the scrubber head against the surface to be cleaned.

Although the present invention has been described in conjunction with the preferred embodiment, it is to be understood that variations and modifications may be resorted to without departing from the spirit and scope of the invention herein, as those skilled in the art will readily understand. Such modifications and variations are considered to be within the purview and scope of the invention and the appended claims.

I claim:

1. A surface cleaning device comprising:

a scrubber head defining a cavity in a surface thereof with a dispensing inlet and removal outlet being provided within the cavity;

a cleaning element positioned within the cavity and having a surface communicating with the dispensing inlet and the removal outlet;

a supply of cleaning fluid from the supply of cleaning fluid to the dispensing inlet, through the cleaning element onto a surface to be cleaned as desired;

means for removing the cleaning fluid along with any contaminants, removed form the surface to be cleaned, directly through the cleaning element;

wherein said means for removing the cleaning fluid and the contaminants form the surface to be cleaned comprising a separation container connected to the removal outlet, via a conduit and a vacuum pump, connected to the separation container, for drawing used cleaning fluid and contaminants form the scrubber head into the separation container; said separation container is divided into top and bottom portions by a funnel, and a filter is provided in the top portion of the separation container, adjacent the funnel, for removing the contaminants from the used cleaning fluid as it enters the top portion of the separation container, and the used cleaning fluid, after passing through the filter, collects in the bottom portion of the separation container.

2. A surface cleaning device as claimed in claim 1 wherein the scrubber head has a center and the dispensing inlet is positioned adjacent said center of the scrubber head.

3. A surface cleaning device as claimed in claim 2 wherein the removal outlet is positioned adjacent the perimeter of the scrubber head.

4. A surface cleaning device as claimed in claim 1 wherein the supply of cleaning fluid comprises a supply container holding a quantity of cleaning fluid, and the means for supplying the cleaning fluid comprises a pressurized air source connected to the supply container for pressurizing the supply container and providing cleaning fluid to the cleaning element when desired.

5. A surface cleaning device as claimed in claim 1 wherein the separation container includes a one-way valve means, connected to the funnel, for preventing the used cleaning fluid from rising above the funnel.

6. A surface cleaning device as claimed in claim 5 wherein the device is supported on a moveable cart.

7. A surface cleaning device as claimed in claim 1 wherein the cleaning element is a sponge.

8. A surface cleaning device as claimed in claim 1 wherein a screen member is provided in the cavity between the removal outlet and the cleaning element.

9. A surface cleaning device as claimed in claim 1 wherein the cleaning element has an exterior surface shaped to conform closely to the shape of the surface to be cleaned.

10. A surface cleaning device as claimed in claim 1, wherein said device further includes a flushing basin defining a cavity shaped to receive at least the cleaning element of the scrubber head when cleaning of the cleaning element is desired, the flushing basin being connected to a source of fluid for cleaning the cleaning element.

11. A surface cleaning device as claimed in claim 10, wherein a sump pump is provided in the bottom portion of the separation container and connected, via an outlet of the separation container and conduit means, to the flushing basin to provide used cleaning fluid for cleaning the cleaning element.

12. A surface cleaning device as claimed in claim 11, wherein the flushing basin is provided with a switch to activate the sump pump and the means for removing the cleaning fluid.

13. A surface cleaning device as claimed in claim 12 wherein the means for removing the cleaning fluid draws the used cleaning fluid from the flushing basin through the cleaning element and into the separation container during cleaning of the cleaning element.

14. A surface cleaning device as claimed in claim 12 wherein the surface of the cleaning element remote from the cavity is contoured so that a major portion of that remote surface intimately engages the surface to be cleaned.

15. A surface cleaning device as claimed in claim 13 wherein the exterior surface of the cleaning element remote from the cavity has a curved profile.

16. A surface cleaning device as claimed in claim 1, wherein the surface of the cleaning element remote from the cavity is contoured so that the major portion of the remote surface intimately engages the surface to be cleaned.

17. A surface cleaning device as claimed in claim 16, wherein the surface of the cleaning element remote from the cavity has a substantially curved profile.

18. A surface cleaning device comprising:

a scrubber head defining a cavity in a surface thereof with a dispensing inlet and removal outlet being provided within the cavity;

a cleaning element positioned within the cavity and having a surface communicating with the dispensing inlet and the removal outlet;

a supply of cleaning fluid;

means for supplying the cleaning fluid form the supply of cleaning fluid to the dispensing inlet, through the cleaning element onto a surface to be cleaning, as desired;

means for removing the cleaning surface along with any contaminants, removed form the surface to be cleaned, directly through the cleaning element; and a flushing basin defining a cavity shaped to receive at least the cleaning element of the scrubber head when cleaning of the cleaning element is desired, the flushing basin being connectable to a source of cleaning fluid for cleaning the cleaning element when desired.

* * * * *